US007971337B2

(12) United States Patent
Kral et al.

(10) Patent No.: US 7,971,337 B2
(45) Date of Patent: Jul. 5, 2011

(54) METHOD FOR PRODUCING A MICROPHONE MODULE FOR A HEARING AID DEVICE

(75) Inventors: Holger Kral, Erlangen (DE); Joseph Sauer, Strullendorf (DE); Markus Trautner, Nuremberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1008 days.

(21) Appl. No.: 11/772,381

(22) Filed: Jul. 2, 2007

(65) Prior Publication Data

US 2008/0013766 A1 Jan. 17, 2008

Related U.S. Application Data

(62) Division of application No. 10/741,769, filed on Dec. 19, 2003, now abandoned.

(30) Foreign Application Priority Data

Dec. 20, 2002 (DE) ..... 102 60 303

(51) Int. Cl.
*H04R 31/00* (2006.01)

(52) U.S. Cl. ..... 29/594; 29/592.1; 29/609.1; 156/89.11; 156/89.12; 156/250; 181/171; 181/172; 367/170; 367/171; 367/181; 381/173; 381/174; 381/175; 381/396; 381/398

(58) Field of Classification Search ..... 29/592.1, 29/594, 609.1; 156/89.11, 89.12, 250; 181/171, 181/172; 367/170, 171, 181, 140, 141; 381/173–175, 396, 398

See application file for complete search history.

(56) References Cited

U.S. PATENT DOCUMENTS

| | | | | |
|---|---|---|---|---|
| 3,265,819 | A | 8/1966 | Herrmann | |
| 4,854,415 | A | 8/1989 | Goschke | |
| 5,204,917 | A | 4/1993 | Arndt et al. | |
| 6,069,963 | A | 5/2000 | Martin et al. | |
| 6,456,720 | B1 | 9/2002 | Brimhall et al. | |
| 6,493,454 | B1 * | 12/2002 | Loi et al. | 381/328 |
| 6,574,343 | B1 | 6/2003 | Meier | |
| 6,674,869 | B2 | 1/2004 | Paczkowski | |
| 6,865,279 | B2 | 3/2005 | Leedom | |
| 7,191,029 | B2 * | 3/2007 | Marxen et al. | 700/118 |
| 2002/0196954 | A1 * | 12/2002 | Marxen et al. | 381/312 |
| 2003/0066676 | A1 | 4/2003 | Stonikas et al. | |
| 2004/0120540 | A1 | 6/2004 | Mullenborn et al. | |
| 2005/0123157 | A1 | 6/2005 | Kragelund et al. | |

FOREIGN PATENT DOCUMENTS

| | | |
|---|---|---|
| DE | 691 11 668 | 10/1991 |
| DE | 196 35 229 | 3/1998 |
| DE | 19852758 A1 | 5/2000 |
| DE | 20007737 U1 | 8/2000 |
| WO | 0203399 A1 | 1/2002 |

* cited by examiner

*Primary Examiner* — Paul D Kim
(74) *Attorney, Agent, or Firm* — Schiff Hardin LLP

(57) ABSTRACT

The production of a hearing aid device can be simplified by the use of a microphone module with a plurality of microphones. To attach and electrically contact the microphones, the invention provides a microphone carrier with three-dimensionally directed conductor traces in MID technology. In a complicated microphone arrangement with a plurality of microphones, a single microphone module can thereby be used on which all microphones of the hearing aid device are attached and electrically connected.

12 Claims, 3 Drawing Sheets

METHOD FOR PRODUCING A MICROPHONE MODULE FOR A HEARING AID DEVICE

CROSS-REFERENCE TO RELATED APPLICATIONS

This Application is a divisional of parent application Ser. No. 10/741,769, filed Dec. 19, 2003, now abandoned. The parent application is herein incorporated by reference.

BACKGROUND OF THE INVENTION

The invention concerns a microphone module for a hearing aid device with a microphone carrier to which a plurality of microphones are attached, as well as a method to produce such a microphone module.

For cosmetic reasons, there is with hearing aid devices the desire for an extensive miniaturization of the devices. Furthermore, the devices should be as cost-effective as possible. In order to be able to achieve these goals, high standards are employed in the production and test methods. The generation of individual modules that can be prefabricated before the assembly of the hearing aid device, and also can be individually tested first with regard to their functionality, represents a possibility for lowering the production costs of a hearing aid device.

Hearing aid devices are known with a plurality of microphones that are arranged on a common carrier, and thus form a microphone module that can be integrated as a structural unit in the housing of a hearing aid device, or can be connected with a housing of a hearing aid device. For example, German patent document DE 196 35 229 A1 shows such a hearing aid device.

Components are known from the electro-technical industry in which injection-molded plastic moldings are provided with three-dimensionally directed conductor traces. These components are designated as MID (Molded Interconnect Devices) and, for example, used as chip sockets or plug connections. The MID technology allows mechanical and electronic functions to be combined in a component. Mostly thermoplastic synthetics serve as a base material, however duroplasts [thermosetting materials] or elastomers are also used. The conductor traces are, as a rule, applied directly to the component via metallization. Further electronic components (resistors, capacitors, etc.) can subsequently by applied via gluing or soldering.

A modular hearing device with a microphone, a receiver, an amplifier and a battery is known from German patent document DE 691 11 668 T2, in which the microphone is incorporated into a microphone module, the receiver is incorporated into a receiver module, the amplifier is incorporated into an amplifier module, and the battery is incorporated into a battery module. The individual modules can be removably connected with one another via dovetail-shaped connections. The electrical connection of the individual modules ensues by way of a flexible circuit board that is soldered with contact points of the modules.

A hearing device is likewise known from U.S. Pat. No. 6,456,720, in which a plurality of components are electrically connected with one another via a flexible circuit board.

As to the formation of conductor traces, various methods for metallization and structuring of the synthetic carrier are known, in particular from MID technology, of which the common ones are be briefly mentioned:

In heat stamping, the synthetic substrate is metallized and structured in one step. With a stamping die on which the positive conductor pattern is applied, a copper stamping foil with an intermediate bonding layer is pressed under pressure and the addition of heat onto the synthetic substrate. The substrate is melted on the surface via the heating effect. The conductor traces are cropped from the copper foil and connected with the substrate.

In metal-backed injection, a structured conductive pattern develops on a foil via screen or pad printing of a primer. During a conditioning process under temperature, the primer undergoes a chemical connection with the substrate surface and provides for a good bond strength. In this process, the foil is simultaneously formed. The foil is subsequently placed in an injection molding machine and back-injected. After the back-injection, the conductor traces are galvanically strengthened and refined.

In the two-component injection molding method, the structure of the conductive pattern is produced with a first injection molding made of metallizable synthetic that serves as a substrate for the chemical metallization. Depending on the synthetic, the surface must be treated again after the first injection molding. The small injection is newly inserted/loaded into a mold and extrusion-coated with non-metallizable synthetic. The free remaining conductor traces are subsequently chemically metallized and enriched.

In the masking method, the metallization of the synthetic carrier ensues via chemical coating. A synthetic injection molding part serves as a substrate in which the surface is initially prepared via corrosion or, respectively, etching for the next step of the process. The metallization subsequently ensues. A photoresist is applied for structuring and exposed with UV light via a three-dimensional mask. After development of the photoresist, the uncovered metal layer is galvanically strengthened and coated with an etching mask. After removal of the photoresist, the remaining metal is etched away and the surface is subsequently enriched.

In contrast to the masking method, in direct laser structuring the etching resist is directly structured with the laser. At the points at which the etching resist was removed by the laser, the metal is etched away. The surface is subsequently enriched.

In the LPKF laser direct structuring method, which is named after the company LPKF, a synthetic part is first injection molded. The transfer of the structure pattern subsequently ensues with a writing or imaging laser system. The subsequent metallization ensues in a chemically reductive bath.

SUMMARY OF THE INVENTION

It is the object of the present invention to simplify the production of a hearing aid device with a plurality of microphones.

This object is achieved via a microphone module for a hearing aid device with a microphone carrier on which a plurality of microphones are attached, where the microphone carrier is fashioned as a solid plastic molding with three-dimensionally directed conductor traces for electrical connection of the microphones.

Furthermore, the object is achieved via a method for production of a microphone module for a hearing aid device, with the following steps:

a) generation of a microphone carrier in the form of a solid plastic molding, from a synthetic material, b) application of three-dimensionally directed conductor traces on the synthetic material, c) attachment of microphones on the carrier, and production of electrical connections between microphone contacts and the conductor traces.

A microphone carrier is generated first in the production of a microphone module according to the invention. In a preferred embodiment, this is designed such that all microphones present in a hearing aid device can be attached to it. In order to allow for the acoustic requirements for the microphones as well as the crowded space proportions in the housing of a hearing aid device, inevitably an uneven shaping normally results for the microphone carrier.

The microphone module according to the invention assumes not only the function of attaching the microphones, but additionally and advantageously serves at least in part for electrically connecting the microphones among one another and with an electronic signal processing unit in the hearing aid device. In order to enable an almost arbitrary shaping of the microphone carrier, the carrier is preferably constructed from a thermoplastic, duroplastic or elastomer synthetic material. According to an embodiment of the invention, direct conductor traces for the electrical connection of the microphones are also applied to this synthetic material. Alternatively, the conductor traces can also be wholly or partially enclosed by the synthetic material of the microphone carrier.

The formation of the microphone carrier in MID technology enables both an almost arbitrary shaping of the microphone carrier and the generation of three-dimensionally directed conductor traces on the microphone carrier or, respectively, in the microphone carrier for electrical connection of the microphones. This has a plurality of advantages according to various embodiments of the invention:

Via the microphone carrier, the microphones may be combined in a simple and cost-effective manner into a modular structural group—a microphone module. This can be directly soldered to the microphone carrier to attach the microphones. The electrical connection is thus also simultaneously produced. Since the microphones are already electrically connected with one another via the conductive pattern applied to the microphone carrier, two conductors (positive pole, ground conductor) are sufficient for a voltage supply of all microphones of the hearing aid device, for which, until now, two conductors for each microphone have been necessary. Furthermore, the microphones can already be tuned to one another and tested with regard to their transmission behavior after the assembly of the module, before their installation and integration into a hearing aid device.

A further advantage is that, in a simple manner, a plurality of different hearing device variants can be generated via different microphone modules that, for example, can be equipped with two, three or more microphones. Different functionalities of the resulting hearing device can result, and thus different hearing device variants, depending on with which type of microphone module (for example, with two, three or four microphones) a hearing device is equipped.

Furthermore, embodiments of the invention offers the advantage that the microphone carrier can be equipped with further electronic components in addition to the microphones. If the microphones are omnidirectional microphones, an electrical circuiting of the microphones is necessary for assembly of a directional microphone system. The microphone signal of at least one microphone must be delayed and inverted and added to the microphone signal of a further microphone. For this, necessary components (for example, delay elements and inverters) are advantageously directly placed on the microphone carrier, such that the microphone module already generates a distinct directional characteristic. The microphone carrier may also comprise the conductor traces for electrical connection of these components. Moreover, in modern hearing devices, at least one digital signal processing ensues. The embodiments of the invention also enable the attachment of A/D converters on the microphone carrier, such that digital signals are already supplied by the microphone module.

The electrical contacts of a microphone module according to embodiments of the invention can be realized via stranded conductors, flexible circuit boards or plug connectors. Furthermore, it is possible that the microphone module itself serves as a plug connector.

To generate a directional microphone system from a plurality of omnidirectional microphones electrically circuited with one another, it is necessary that the microphones are very precisely tuned to one another with regard to their amplitudes and phase transmission behavior. The embodiments of the invention also offer advantages in that components (for example, resistors and capacitors) necessary for microphone tuning may be directly arranged with one another on the microphone carrier. The microphones can thus advantageously already be tuned ("matched") before the installation in the hearing aid device. A directional microphone system can thus be produced, calibrated and tested as a separate physical unit. Last, but not least, advantages also result in the event of repairs of a hearing device. Instead of individually replacing defective microphones, the complete microphone module may now be exchanged, foregoing the calibration of a replaced microphone with microphones remaining in the hearing device.

Via the invention, it is furthermore possible to shrink the microphone modules such that they fit into hearing aid devices of smaller design, for example behind-the-ear hearing aid devices. Additionally, this achievable reduction of the number of the connection wires for electrical connection of the microphones (for example, from nine to five connection wires in a microphone module with three microphones), via the softer arrangement of the microphone module connected therewith, brings an acoustic advantage.

A further embodiment of the invention provides an oscillation-damped arrangement of a microphone module according to the invention in a hearing aid device. The oscillation-damped arrangement can ensue both via the microphones and via the microphone carrier. For example, for this the microphones and also the socket of the microphone inlet may be coated with elastic, oscillation-damping material, for example, rubber jackets. An oscillation-damping arrangement of the individual microphones in the housing of a hearing aid device is thus no longer necessary. Damping elements made of elastic, oscillation-damping materials are also advantageously located between the microphone carrier and acceptances for mounting the microphone carrier in the hearing device housing. The entire microphone module may thus be largely decoupled from the housing of the hearing aid device via oscillation technology.

The microphone module according to the invention can be used in all common hearing device designs, for example, in in-the-ear hearing aid devices (IdOs), behind-the-ear hearing aid devices (HdOs), pocket hearing aid devices, and so forth.

DESCRIPTION OF THE DRAWINGS

Further advantages and details of the invention emerge from the subsequent specification of exemplary embodiments of the invention and the drawings.

DETAILED DESCRIPTION OF THE PREFERRED EMBODIMENTS

Figure 1:
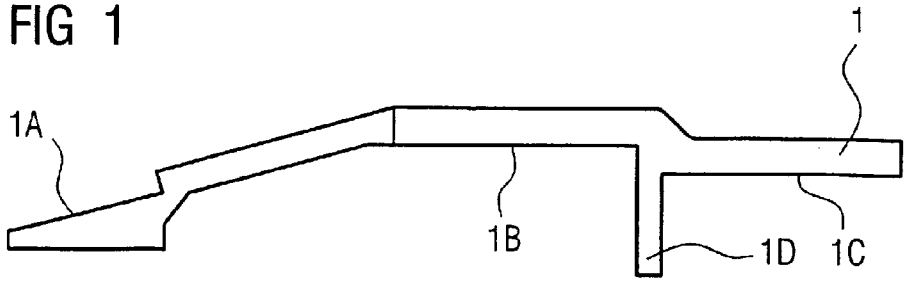
FIG. 1 is a side view pictorial diagram of a microphone carrier.

FIG. 1 shows a microphone carrier 1 fashioned as a plastic injection-molded part, in side view. To form a microphone module, three microphones can be attached to the microphone carrier 1 in sections 1A, 1B and 1C of the microphone carrier 1. Two of the microphones are spatially separated by a web 1D of the microphone carrier 1.

In the production of the microphone carrier according to an embodiment of the invention, in a first method step, a plastic injection-molded part is produced in the shape visible from FIG. 1. To generate conductor traces on the plastic injection-molded part, the method steps add metallization and structuring. For attachment and electrical contacting, a plurality of microphones are subsequently soldered onto the thusly produced microphone carrier 1.

Figure 2:
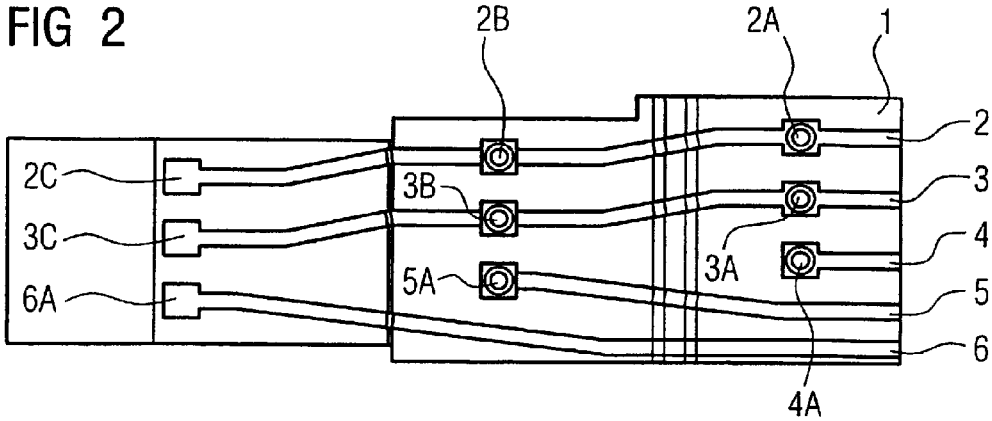
FIG. 2 is a top view pictorial diagram of a microphone carrier.

FIG. 2 shows the microphone carrier 1 from above. From this view, the conductor traces 2-6 directly applied on the microphone carrier 1 for electrical contacting of the microphones are visible. It is clear that both conductor traces 2 and 3 for the voltage supply of the microphones respectively comprise contacts for contacting all three microphones. Furthermore, the microphone carrier 1 comprises a separate signal line/conductor for each microphone. In the assembly of the microphone module, the microphone arranged in the partition 1A of the microphone carrier 1 visible from FIG. 1 is soldered with its microphone contacts to the contact points 2C, 3C and 6A for attachment and for electrical connection. The attachment and contacting of both other microphones ensues on the bottom of the microphone carrier 1. The conductor traces 2-5 are therefore provided with feed-through holes 2A, 2B, 3A, 3B, 4A and 5A, through which the conductor traces are passed for further continuation on the bottom of the microphone carrier 1.

Altogether, the electrical connection of the three microphones ensues via the five conductor traces 2-6. To connect the microphone module with an amplifier (not shown), only five (instead of the normal nine) connection conductors are thus necessary. The microphone module thereby contributes to a lowering of the production costs of a hearing aid device.

Figure 3:
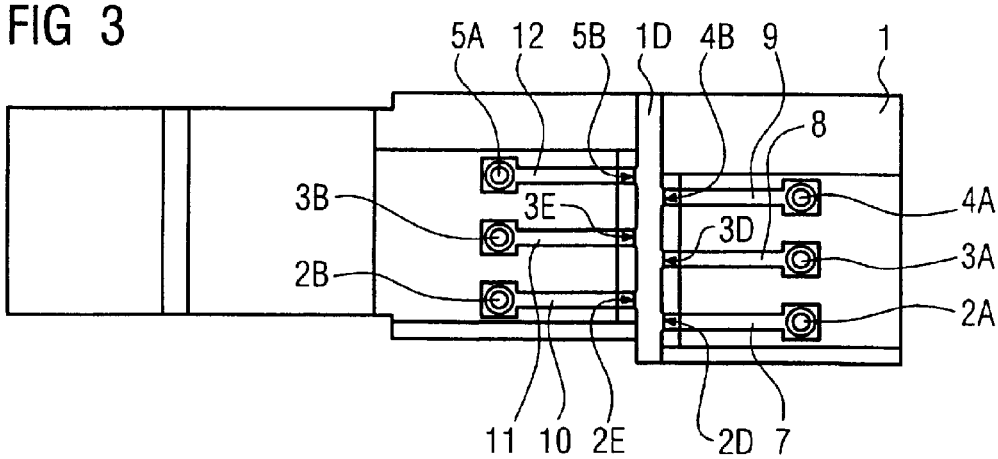
FIG. 3 is a bottom view pictorial diagram of a microphone carrier.

The bottom of the microphone carrier 1 is visible from FIG. 3. The microphone carrier 1 in the exemplary embodiment also comprises conductor traces on its bottom, namely the conductor traces 7 and 10 that are continuations of the conductor trace 2, the conductor traces 8 and 11 that are continuations of the conductor trace 3, the conductor trace 9 that is a continuation of the conductor trace 4, and the conductor trace 12 that is a continuation of the conductor trace 5. The continuations of the conductor traces may be (as is specified in FIG. 2) formed by way of the feed-throughs 2A, 2B, 3A, 3B, 4A and 5A for continuation of the respective conductor trace on the opposite side of the microphone carrier 1. The conductor trace sections on the bottom of the microphone carrier 1 respectively end at a contact point 2D, 3D, 4B (for one microphone) or, respectively, 2E, 3E, 5B (for a further microphone). The contact points for respectively one microphone may be separated from one another by the web 1D. Both microphones on the bottom of the microphone carrier 1 may be also soldered with the contact points 2D, 3D 4B, 2E, 3E and 5B for attachment as well as for electrical connection.

Figure 4:
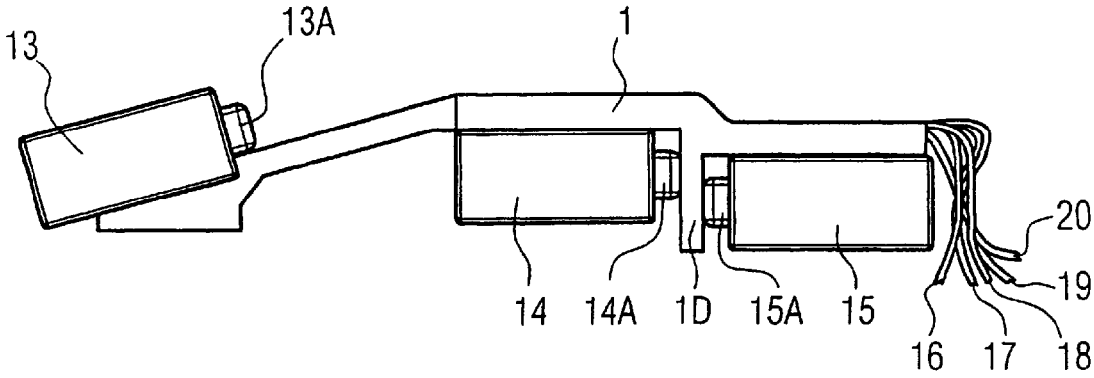
FIG. 4 is a side view pictorial diagram of a microphone carrier equipped with three microphones.

FIG. 4 shows the microphone carrier 1 with the three microphones 13, 14 and 15 attached on it. Each microphone comprises three microphone contacts, of which respectively only the front microphone contact 13A, 14A or, respectively, 15A is visible in FIG. 4. The microphone 13 is soldered to its microphone contacts at the contact points 2C, 3C and 6A (compare FIG. 2) on the top of the microphone carrier; the two microphones 14 and 15 with their microphone contacts are soldered to the contact points 2D, 3D, 4B or, respectively, 2E, 3E and 4B on respectively one side of the web 1D (compare FIG. 3). Furthermore, five connection cables 16-20 are visible for electrical connection of the microphone module with an amplifier unit (not shown).

Figure 5:
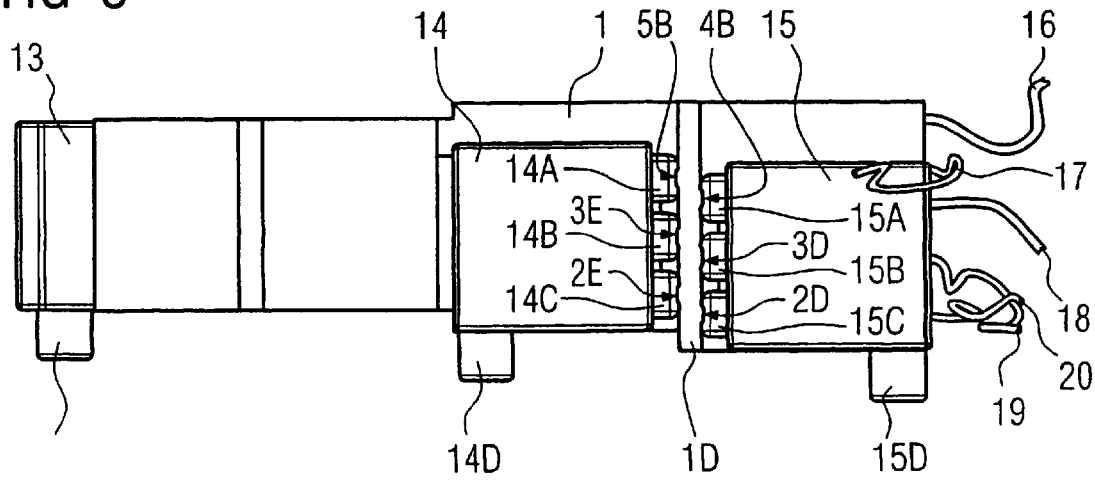
FIG. 5 is a bottom view pictorial diagram of a microphone carrier equipped with three microphones.

FIG. 5 shows the microphone module with the microphone carrier 1 and the three microphones 13, 14 and 15 from below. From this view, three sound inlets (fashioned as sockets 13D, 14D and 15D) of the microphones 13-15 are visible. Furthermore, from this view, at the microphones 14 and 15 their microphone contacts 14A, 14B, 14C or, respectively, 15A, 15B, 15C are recognizable. These are soldered to the contact points 2E, 3E, 5B or, respectively, 2D, 3D, 4B on opposite sides of the web 1D. In addition, FIG. 5 also shows the five connection cables 16-20 for electrical connection of the microphone module with an amplifier unit (not shown).

Figure 6:
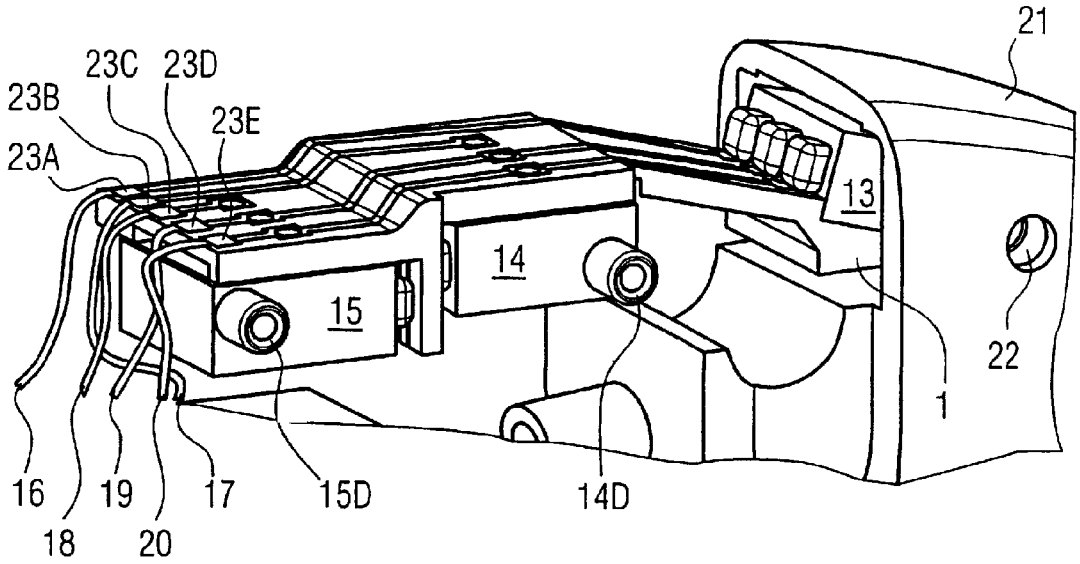
FIG. 6 is an isometric view pictorial diagram of a partition of a behind-the-ear hearing aid device in which a microphone module according to the invention is used.

FIG. 6 shows a section of a behind-the-ear hearing aid device 21 in which a microphone module according to the invention is located. In FIG. 6, the microphone module is not fully located in its end position in the installed state, and therefore partially protrudes over the housing of the hearing aid device 21. On the top of the microphone carrier 1, respectively one test port 23A-23E for contacting a test device is located in the region of the connection cable 16-20 on the conductor traces. The correct function of the microphone module can, by this, be tested before the installation in the hearing aid device. Defective microphone modules can thus be eliminated early in the production process of the hearing aid device. Furthermore, FIG. 6 shows a sound aperture opening 22 in an uncropped shown region of the housing of the hearing aid device 21. In the installed microphone module, the socket 13D of the microphone 13 (not visible from FIG. 6; compare FIG. 5) protrudes in this sound aperture opening. The sockets 14D, 15D of the remaining microphones likewise protrude in corresponding further housing openings of the hearing aid device 21 (not shown). The microphone module is thereby fixed in the hearing aid device 21 in a simple manner.

Figure 7:
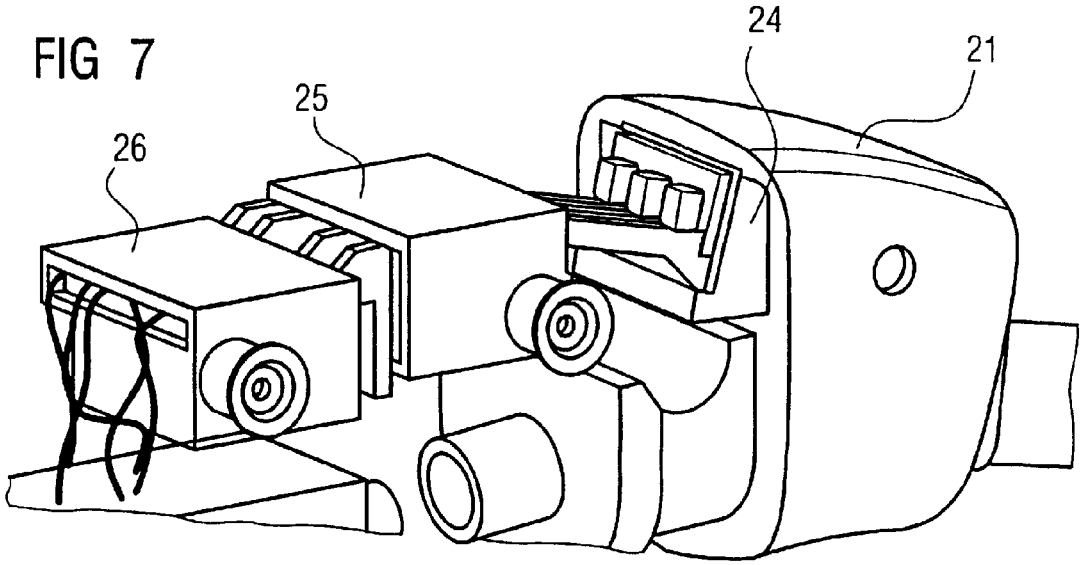
FIG. 7 is an isometric view pictorial diagram of the partition as well as the microphone module according to FIG. 6, where the microphones are provided with jackets made of elastic material for oscillation-damping arrangement.

FIG. 7 shows the section of the hearing aid device 21 (corresponding to FIG. 6) with the microphone module according to an embodiment of the invention in detail. However, in contrast to FIG. 6, in the embodiment according to FIG. 7 the microphones as well as the sockets are encased in jackets 24, 25 and 26 made of elastic, oscillation-damping material, that to some extent even enclose the microphone carrier. The attachment of the microphone module in the hearing aid device 21 and the oscillation-technical decoupling of the microphone module from the housing of the hearing aid device 21 is thereby improved. Moreover, damping elements (not shown) can likewise be located at further connection points of the microphone carrier 1 with the housing of the hearing aid device 21.

Figure 8:
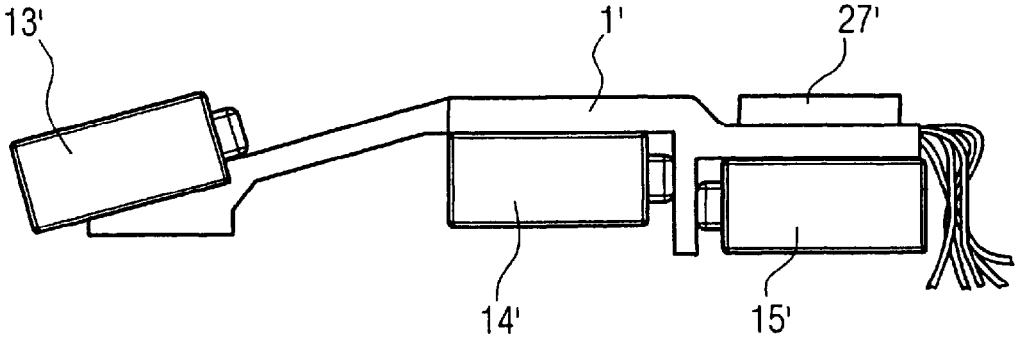
FIG. 8 is a side view pictorial diagram of a microphone module that comprises electrical components for circuiting the microphones and signal processing.

FIG. 8 shows a development of the invention. A plurality of omnidirectional microphones 13', 14' and 15' are thereby arranged on a common microphone carrier 1' and electrically circuited with one another to form a directional microphone system. In this embodiment, the electronic components necessary for electrical circuiting (for example, delaying elements and inverters) are advantageously likewise directly mounted on the microphone carrier 1'. The components are comprised in the physical unit 27' that is arranged over the microphone 15' on the microphone carrier 1' in the exemplary embodiment.

The physical unit 27' can be implemented as an integrated circuit, and thus as an electronic component with it own housing. However, a plurality of electrical components can likewise also be placed in a distributed manner on the microphone carrier 1'. The conductor traces for electrical connection of the component 27' are also advantageously located directly on the microphone carrier. A directional microphone system can thus by realized in a simple manner, in that electronic components necessary to fashion the directional microphone system are also comprised by the microphone module. The microphones 13', 14', 15' of the microphone module can then already be calibrated before the microphone module is used in a hearing aid device. The calibration with regard to the transmission behavior of the microphones 13', 14', 15' is particularly necessary when a directional microphone system of higher order should be formed via electrical circuiting.

Furthermore, the microphone carrier 1' can be provided with further electrical components, where the functionality of the microphone module is, for example, expanded to the effect that a signal preamplification and A/D conversion of the microphone signals also ensues. These components can also be comprised by a single integrated circuit on the microphone carrier. However, a plurality of electrical components can also be mounted on the microphone carrier 1'. Digital, and thus largely interference-insensitive signals are thus already supplied from the microphone module to the signal outputs.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional electronics and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 microphone carrier
1A, 1B, 1C sections of the microphone carrier
1D web
2-12 conductor traces
2A, 3A, 4A; feed-throughs
2B, 3B, 5A
2C, 3C, 6A; contact points
2D, 3D, 4B;
2E, 3E, 5B
13, 14, 15; microphones
13', 14', 15'
13A; microphone contacts
14A, 14B, 14C;
15A, 15B, 15C
13D, 14D, 15D sockets
16-20 connection cable
21 hearing aid device
22 sound aperture opening
23A, 23B, 23C, test ports
23D, 23E
24, 25, 26 jackets
27' electrical component

What is claimed is:

1. A method for producing a microphone module for a hearing aid device, comprising:

generating a microphone carrier as a molded interconnect device in the form of a solid plastic molding from a synthetic material;

applying three-dimensionally directed conductor traces on the synthetic material on an outside surface of the microphone carrier;

attaching microphones and at least one component on the outside surface and outside of the microphone carrier after the applying of the conductor traces, said at least one component creating directionality to form a directional microphone system together with said microphones;

when attaching the microphones on the microphone carrier after applying said conductor traces producing electrical connections between microphone contacts and the conductor traces.

2. The method according to claim 1, wherein:

said at least one component for said directional microphone system creating said directionality by at least one of amplitude and phase compensation of the microphones.

3. The method according to claim 1, wherein:

said at least one component arranged on the microphone carrier creating said directionality by signal processing microphone signals generated by the microphones.

4. The method according to claim 1, further comprising:

providing test ports on the microphone carrier to test the microphones attached to the microphone carrier.

5. The method according to claim 1, further comprising:

providing a dampening mechanism for oscillation-damping positioning of the microphone module in the hearing aid device.

6. The method according to claim 1, wherein the conductor traces are attached only to the outside surface which is three-dimensional of the microphone carrier and which follow the contour of the surface.

7. The method according to claim 1, wherein the conductor traces follow a contour of the outside surface for their entire length.

8. The method according to claim 1, wherein the entire conductor traces are in contact with the carrier.

9. The method according to claim 1, wherein the carrier does not bound a cubic volume on more than three sides.

10. The method according to claim 1, wherein the carrier does not enclose a volume.

11. The method according to claim 1, wherein the microphone carrier comprises three-dimensionally directed conductor traces on the outside surface for electrical connection of the microphones at a point on the outside surface.

12. The method according to claim 1, wherein the microphones are replaceable on the microphone module.

* * * * *